US010335705B2

(12) United States Patent
Byrne et al.

(10) Patent No.: US 10,335,705 B2
(45) Date of Patent: Jul. 2, 2019

(54) VENUE TRAYS AND METHOD FOR MOVING VENUE TRAYS

(71) Applicant: Tait Towers Manufacturing LLC, Lititz, PA (US)

(72) Inventors: Owen Byrne, Lancaster, PA (US); Adam Davis, Leola, PA (US); Tyler Kicera, Manheim, PA (US); Ryan Mast, Lancaster, PA (US); Benjamin Asher Samberg, Lancaster, PA (US)

(73) Assignee: Tait Towers Manufacturing LLC, Lititz, PA (US)

( * ) Notice: Subject to any disclaimer, the term of this patent is extended or adjusted under 35 U.S.C. 154(b) by 0 days.

(21) Appl. No.: 16/063,140

(22) PCT Filed: Apr. 20, 2016

(86) PCT No.: PCT/US2016/028340
§ 371 (c)(1),
(2) Date: Jun. 15, 2018

(87) PCT Pub. No.: WO2017/105540
PCT Pub. Date: Jun. 22, 2017

(65) Prior Publication Data

US 2019/0022547 A1 Jan. 24, 2019

Related U.S. Application Data

(60) Provisional application No. 62/269,417, filed on Dec. 18, 2015.

(51) Int. Cl.

| | |
|---|---|
| ***A63J 1/00*** | (2006.01) |
| ***E04H 3/26*** | (2006.01) |
| ***E04H 3/30*** | (2006.01) |

(52) U.S. Cl.
CPC ..... *A63J 1/00* (2013.01); *E04H 3/26* (2013.01); *E04H 3/30* (2013.01)

(58) Field of Classification Search
CPC .... A61J 1/00; A61J 19/00; A61J 19/10; A61J 5/02; E04H 3/00; E04H 3/22; E04H 3/24;
(Continued)

(56) References Cited

U.S. PATENT DOCUMENTS 1,819,656 A * 8/1931 Pressley ..... A63J 1/00 108/139
5,765,314 A 6/1998 Giglio et al.
(Continued)

OTHER PUBLICATIONS

International Search Report and Written Opinion for PCT/US2016/028340 dated Jul. 29, 2016, 7 pages.

*Primary Examiner* — Kien T Nguyen
(74) *Attorney, Agent, or Firm* — Blank Rome LLP

(57) ABSTRACT

The present invention relates to a method for positioning audience members at locations for viewing an event occurring at an event portion at which a live actor makes a presentation and/or a display is shown. Additionally, the present invention relates to an arrangement having a first venue tray, the first venue tray having a close range event portion at which a live actor can make a presentation and/or a display can be shown and a home row seating section, a second venue tray, the second venue tray having a down-range seating section, a first periphery event portion at which a live actor can make a presentation and/or a display can be shown, and a second periphery event portion.

16 Claims, 11 Drawing Sheets

(58) Field of Classification Search
CPC .... E04H 3/26; E04H 3/28; E04H 3/30; A63B 9/00
USPC ..... 472/75–84; 52/6–9
See application file for complete search history.

(56) References Cited

U.S. PATENT DOCUMENTS

| | | | | |
|---|---|---|---|---|
| 6,253,494 | B1 | 7/2001 | Shaffron | |
| 2003/0153392 | A1* | 8/2003 | Maclaren | A63C 19/10 472/91 |
| 2010/0146869 | A1 | 6/2010 | Stelmaszek et al. | |
| 2010/0203976 | A1* | 8/2010 | Wei | A63B 9/00 472/75 |

* cited by examiner

VENUE TRAYS AND METHOD FOR MOVING VENUE TRAYS

RELATED APPLICATIONS

This application is a national phase of PCT/US2016/028340, filed on Apr. 20, 2016, which claims the benefit of U.S. Provisional Application No. 62/269,417, filed Dec. 18, 2015. The entire contents of these applications are hereby incorporated by reference.

CROSS REFERENCE TO RELATED PATENT APPLICATIONS

This application claims the benefit of U.S. Provisional Patent Application No. 62/269,417, filed Dec. 18, 2015, which is hereby incorporated by reference in its entirety.

FIELD OF THE INVENTION

The present disclosure relates to a method for positioning audience members at locations for viewing an event occurring at an event portion at which a live actor makes a presentation and/or a display is shown. Additionally, the present invention relates to an arrangement having a first venue tray, the first venue tray having a close range event portion at which a live actor can make a presentation and/or a display can be shown and a home row seating section, a second venue tray, the second venue tray having a downrange seating section, a first periphery event portion at which a live actor can make a presentation and/or a display can be shown, and a second periphery event portion.

BACKGROUND OF THE INVENTION

British Patent 1,117,377 to Rossman, granted in 1968, discloses a revolving audience seat arrangement. Seats 20 can revolve to face a main auditorium area 10 or to face a smaller lecture area 15. While this arrangement provides an approach for varying the sight lines along which audience member view performances, there still remains room for improved arrangements that further enhance the experience of audience members viewing or listening to a performance.

BRIEF DESCRIPTION OF THE INVENTION

One aspect of the disclosure relates to a method for positioning audience members at locations for viewing an event occurring at an event portion at which a live actor makes a presentation and/or a display is shown.

Another aspect of the disclosure relates to an arrangement having a first venue tray, the first venue tray having a close range event portion at which a live actor can make a presentation and/or a display can be shown and a home row seating section, a second venue tray, the second venue tray having a downrange seating section, a first periphery event portion at which a live actor can make a presentation and/or a display can be shown, and a second periphery event portion.

An advantage of the present disclosure is that a capability is provided to selectively vary a number of properties of a venue in a manner that varies the visual and/or audio perspectives of an individual audience member during the course of an event at the venue.

Further aspects of the present invention are disclosed herein. The features as discussed above, as well as other features and advantages of the present disclosure, will be appreciated and understood by those skilled in the art from the following detailed description and drawings.

Other features and advantages of the present invention will be apparent from the following more detailed description, taken in conjunction with the accompanying drawings which illustrate, by way of example, the principles of the invention.

BRIEF DESCRIPTION OF THE DRAWINGS

FIG. 5(*b*) is a top perspective view of the venue tray in an arbitrary milestone position;

FIGS. 5(*c*), 5(*d*) are top perspective views of the venue tray arrangement and the arena;

Wherever possible, the same reference numbers will be used throughout the drawings to represent the same parts.

DETAILED DESCRIPTION OF THE INVENTION

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

The present invention provides a method and an arrangement, whereupon it will be appreciated that the arrangement provides the multiple capabilities to: (a) configure an event venue as a so-called "theater-in-the-round" in which audience members remain seated or standing at the same individual location while the seating section as a whole is re-positioned to enable viewing of the same stage from different perspectives, (b) configure an event venue as a so-called "inverse theater-in-the-round" in which audience members remain seated or standing at the same individual location while the seating section as a whole is re-positioned to enable viewing of various stages, or (c) configure an event venue as a proscenium-style stage at which event performances or displays are presented relative to a proscenium-defining structure for viewing by audience members who have remained seated or standing at the same individual location while the seating section as a whole has been re-positioned.

Figure 1:
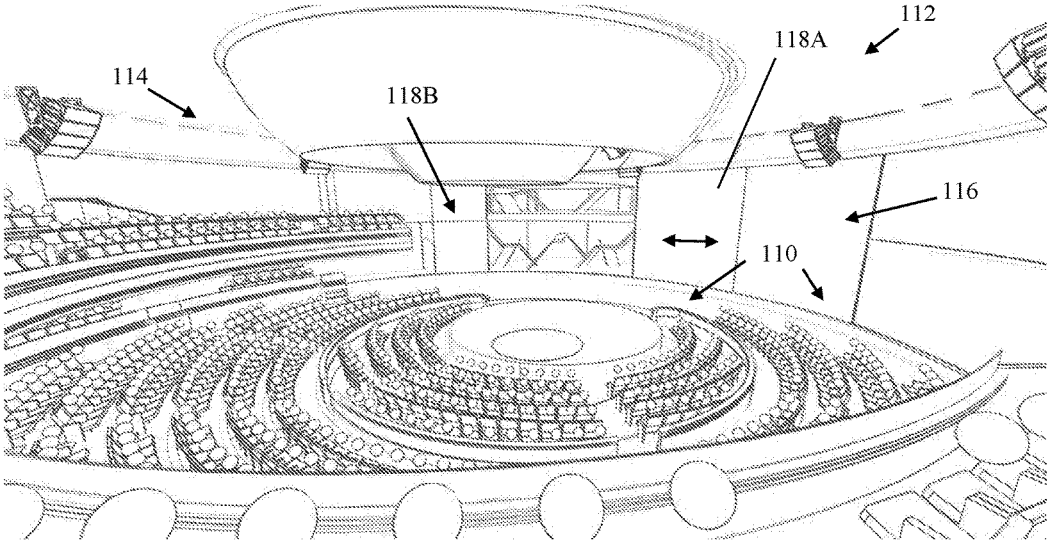
FIG. 1 is a top perspective view of a venue at which an event occurs while persons are in attendance.

As seen in FIG. 1, which is a top perspective view of a venue at which an event occurs while persons are in attendance, the present invention provides one embodiment of a venue tray arrangement 110 configured for deployment in a venue 112 at which audience members are, or will be, in attendance at an event and the venue 112 may be, for example, a land-based site, an atmospheric-based location, or a location on a water-borne vessel. A land-based site may be, for example, a tract of land on which is sited a live actor theater, a media presentation structure such as a projection screen, or a structure suitable for a combination of live actor presentations and media presentations such as light, sound, or light and sound effects. The term "live actor" refers to a person who is acting, addressing other persons, or otherwise engaging in an activity on a stage or a presentation structure; additionally, the term "live actor" may refer to a person who is guiding or controlling the presentation of a display to audience members. The term "audience members" refers to persons attending an event at the venue 112, it being understood that certain events at a venue may include some or all of the audience members each playing the role of a live actor during a portion or the entirety of the event. In the event that the venue 112 is a location on a water-based vessel, this may include, for example, a structure on a ship or other floating or submersible vessel on which is sited a live actor theater, a media presentation structure such as a projection screen, or a structure suitable for a combination of live actor presentations and media presentations such as a light show, a sound show, or a light and sound show.

The venue tray arrangement 110 is configured to be deployed permanently or temporarily in a venue 112 and advantageously provides a capability to selectively vary a number of properties of the venue 112 in a manner that varies the visual and/or audio perspectives of an individual audience member during the course of an event at the venue. An example of a deployment of the venue tray arrangement 110 at a venue 112 for the duration of an event will now be described. In this connection, the venue 112 includes a structure designated as an arena 114 that includes a proscenium-defining partition wall assembly 116 that delimits an annular path surrounding an operating volume in which the venue tray arrangement 110 operates during its deployment. The partition wall assembly 116 provides a proscenium function in that live actor events or displays take place radially inwardly of the partition wall assembly. In certain situations, live actor events or displays may also take place radially outwardly of the partition wall assembly as well. The proscenium-defining partition wall assembly 116 includes a plurality of movable shutters 118, including a pair of movable shutters 118A and 118B that selectively permit access to, or viewing of, areas radially outward of the proscenium-defining partition wall assembly 116.

The venue tray arrangement 110 includes a plurality of sections which can be occupied by audience members and such sections may include individual seating such as, for example, individual chairs, and/or group seating such as, for example, benches on which several persons may sit. Additionally or alternatively, such sections may include floor areas on which audience members may stand or move about while an event is occurring. The venue tray arrangement 110 is exemplarily shown as having individual seats arranged in rows that delimit walking aisles between adjacent rows of seats. Also, solely for the purpose of illustrating the exemplary deployment of the venue tray arrangement 110 described herein, each section of the venue tray arrangement 110 has its rows of individual seats arranged such that the audience members occupying the seats of the respective section are oriented to all be able to see the same display. The term "see the same display" as used herein is intended to mean that the audience members in a respective section can observe the collective ensemble of persons, inanimate or live scenery, or visual media presentations that are present in a front field of view of the respective section although the particular details of such persons, scenery, or visual media presentations seen by each individual audience member will be different than the details observable by other audience members occupying the same respective section, on account of differences of individual locations of the audience members distributed throughout the respective section of the venue tray arrangement 110.

In the following discussion, a viewing direction in which the audience members in a respective section can observe the collective ensemble of persons, scenery, or visual media presentations that are present in a front field of view of the respective section is designated as a "sight line" and a section is designated as "observer-aligned" with a respective sight line when the audience members in that respective section can observe the collective ensemble of persons, scenery, or visual media presentations that are present in the front field of view of the respective section intersected by that respective sight line. It is to be understood that the present invention also contemplates that perceptible auditory emissions may be broadcast or emitted in the arena 114 and a concept of "hearing lines" is parallel to the concept of sight lines in that the audience members in a respective section can be oriented to perceive the auditory emissions of a collective ensemble of persons, inanimate scenery, or visual media presentations that are present at a given orientation to the respective section.

The venue tray arrangement 110 includes a plurality of sections each operable to provide an event attendance location for at least one audience member. The sections of the venue tray arrangement 110 may include sections that remain at a fixed location relative to the partition wall assembly 116 throughout an event and/or sections that are moved relative to the partition wall assembly during an event. The venue tray arrangement 110 includes a plurality of venue trays which are particularly configured to each accommodate a section that is moved relative to the partition wall assembly during an event; thus, the venue tray arrangement 110 includes at least two venue trays and may include any number of venue trays.

Figure 3A:
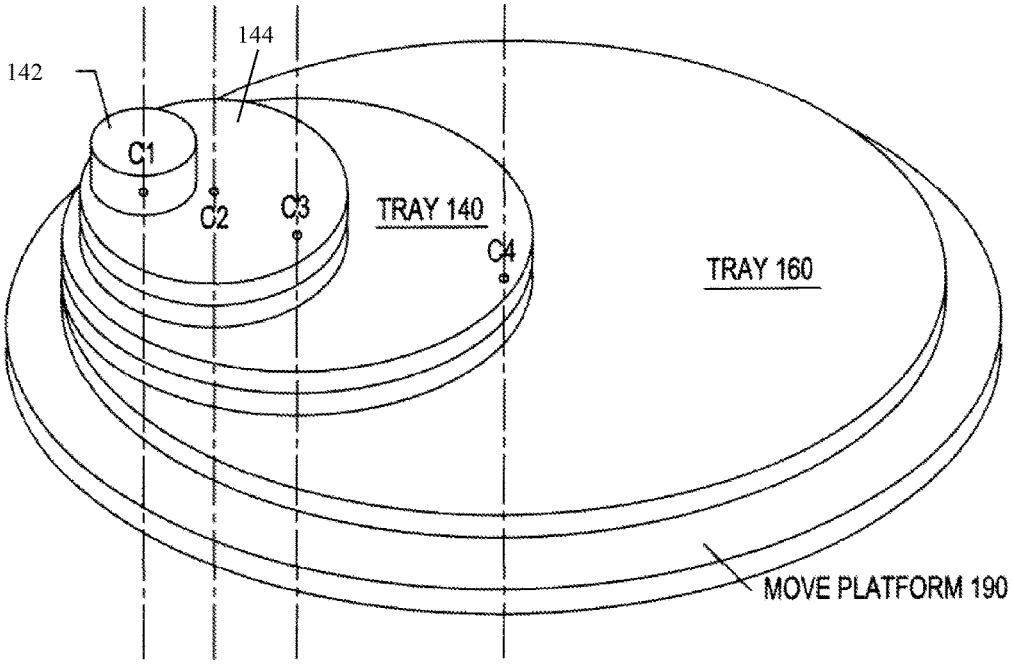
FIGS. 3(*a*), 3(*b*) are top perspective views of a venue tray located in an arbitrary start position and having a flexible configuration stage and a home row seating section.
Figure 3B:
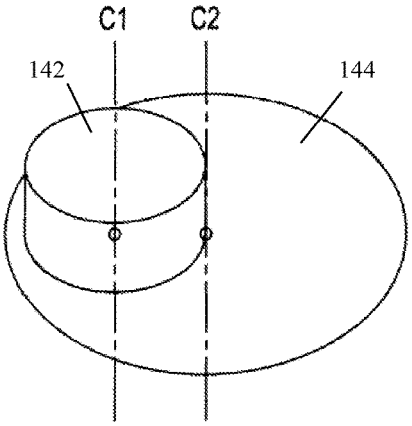
Figure 4:
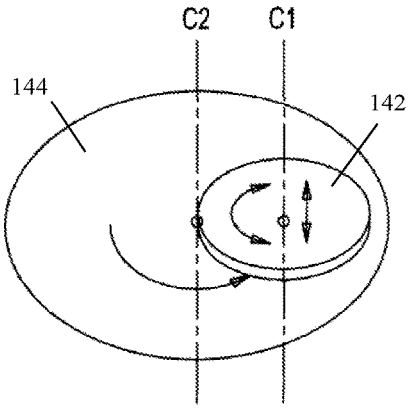
FIG. 4 is a top perspective view of the venue tray shown in FIG. 3 in an arbitrary milestone position.
Figure 5A:
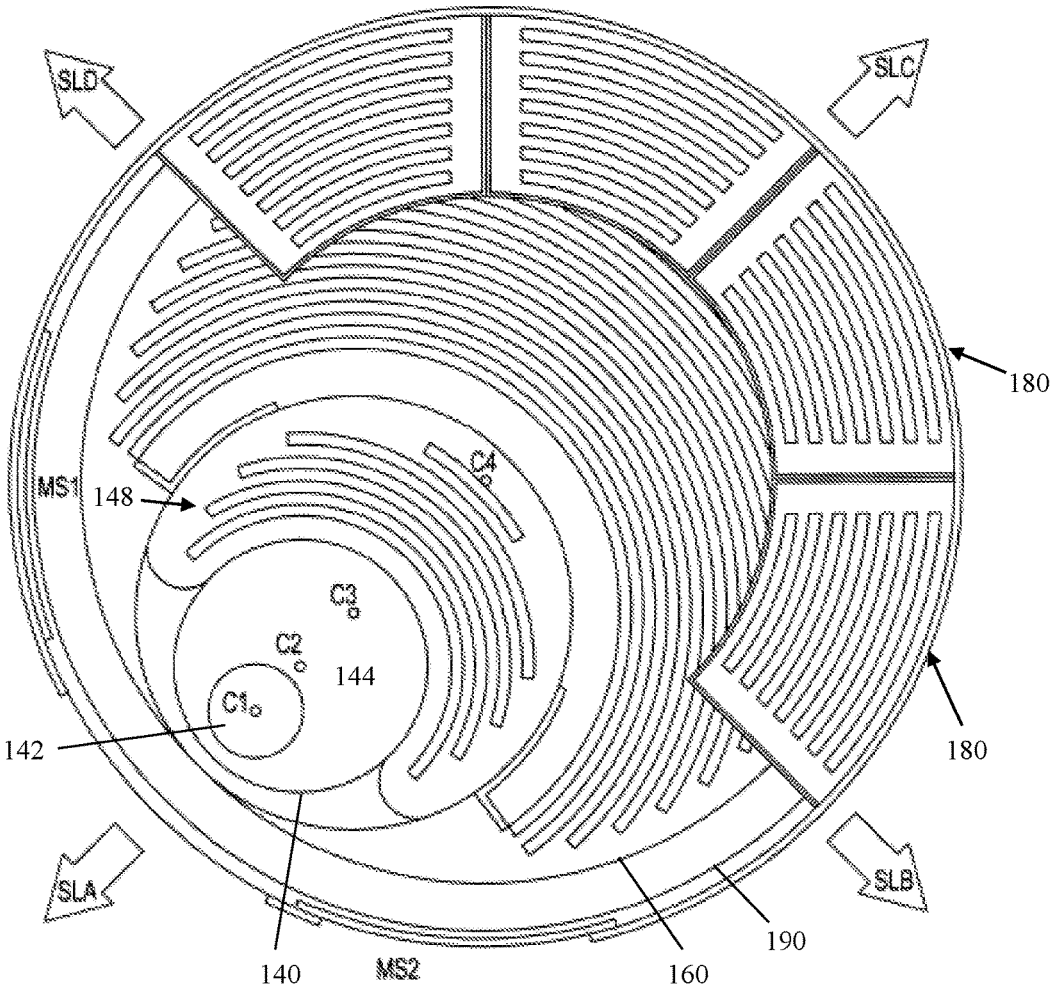
FIG. 5(*a*) is a top perspective view of the venue tray shown in FIG. 3 having a flexible configuration stage and a home row seating section and another venue tray having a downrange seating section.
Figure 5B:
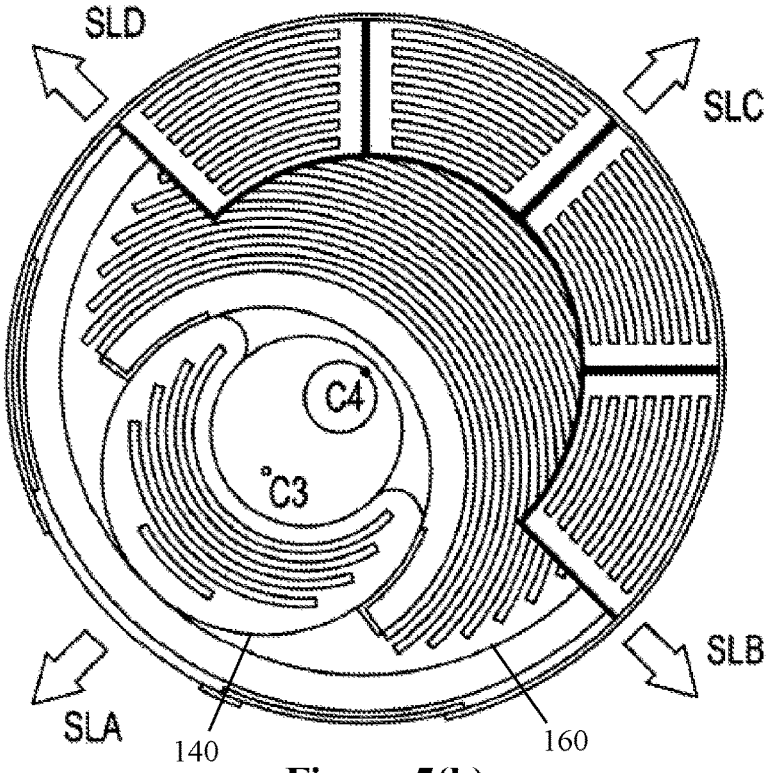
Figure 5C:
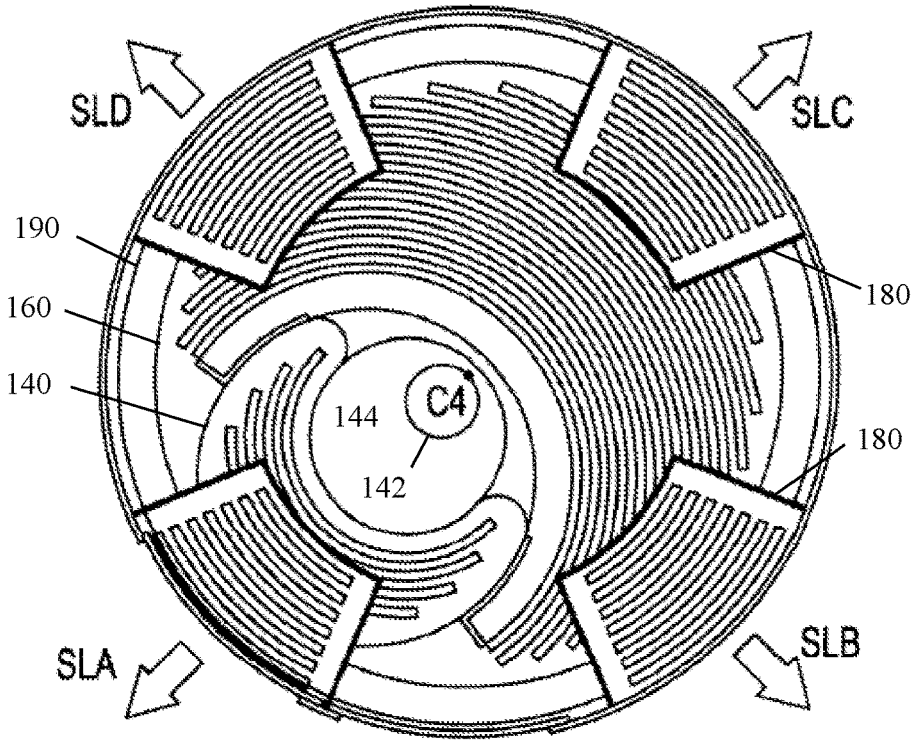
Figure 5D:
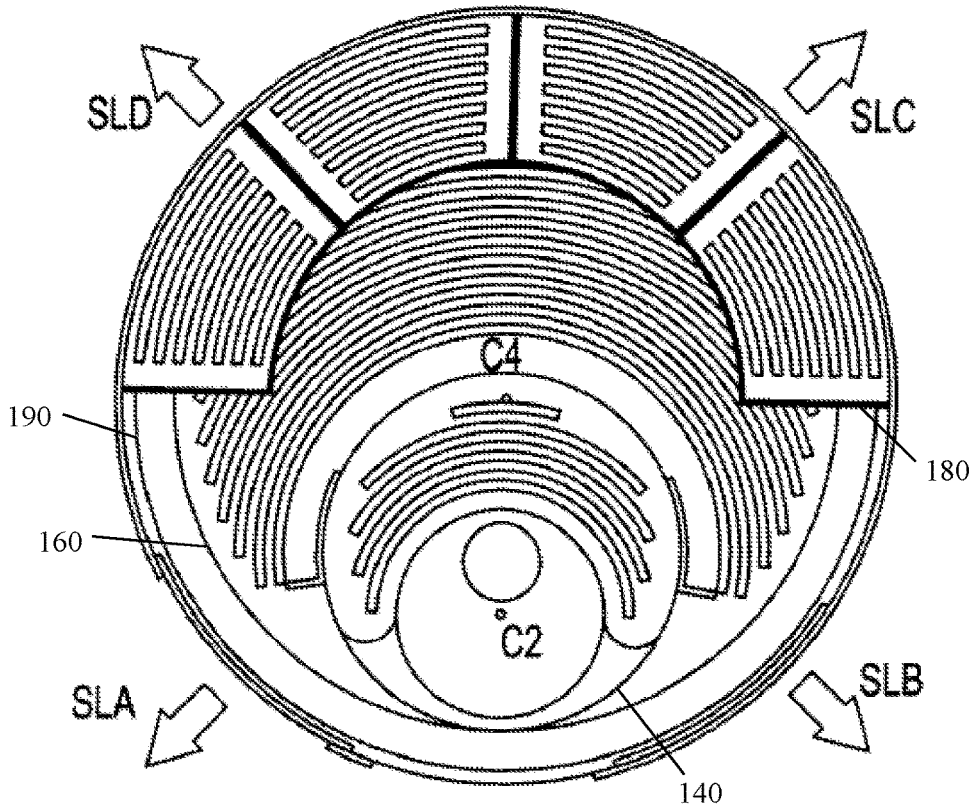

The venue tray is a basic configuration component of the venue tray arrangement 110 and reference is had to FIGS. 3(*a*), 3(*b*) and FIG. 4 in connection with a discussion of the geometries, relative movements, and interconnected operations of the individual elements which may be comprised in a venue tray. As seen in FIGS. 3(*a*), (*b*), which are top perspective views of a venue tray located in an arbitrary start position and having a flexible configuration stage and a home row seating section, a venue tray 140 is comprised of an individual element in the form of a cylindrical isolation platform 142 and an individual element in the form of a disk-shaped rotatable stage 144 whose geometries, relative movements, and interconnected operations are compatibly configured, in a manner described in more detail herein, such that the isolation platform 142 and the disc-shaped rotatable stage 144 can execute coordinated movements. The isolation platform 142 and the disc-shaped rotatable stage 144 collectively form a close range event portion at which the activities of an event can occur.

Figure 2A:
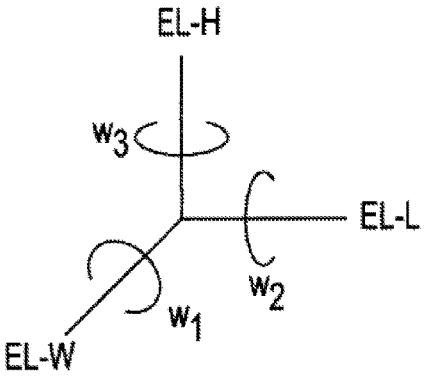
FIGS. 2(*a*), 2(*b*) are schematic perspective views of a slewing movement of the venue tray along a slew path.
Figure 2B:
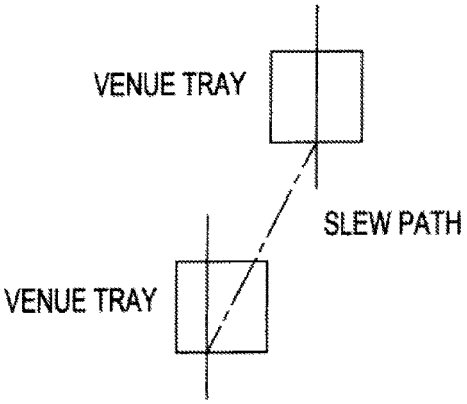

For the sake of discussion, each component of the venue tray arrangement 110 is characterized by a length dimension EL-L, a width dimension EL-W, as measured in a direction perpendicular to its length dimension EL-L, and a height dimension EL-H as measured in a direction perpendicular to its length dimension EL-L and perpendicular to its width dimension EL-W. Additionally, a component may be subjected to movement relative to a rotation axis which can be, respectively, a rotation movement W1 about an axis parallel to its width dimension EL-W, a rotation movement W2 about an axis parallel to its length dimension EL-L, or a rotation movement W3 about an axis parallel to its height dimension EL-H. In the following discussion, the rotation axis of a component is to be understood as an axis parallel to its height dimension EL-H, unless otherwise indicated. Furthermore, a component may be subjected to a slewing movement, which is to be understood as a movement of the component in which the component undergoes translation movement relative to another component of the same venue tray or translation movement relative a structure not comprised in the respective venue tray. Unless otherwise noted herein, a slewing movement of a component occurs in a direction generally parallel to a plane delimited by the width dimension EL-W and the length dimension EL-L of the component. FIG. 2(*a*) schematically shows these respective axes and FIG. 2(*b*) shows a schematic perspective view of a slewing movement of a venue tray 140 along a slew path.

The isolation platform 142 and the disc-shaped rotatable stage 144 are commonly supported on a base 146 of the venue tray 140 such that a translation movement of the base 146 serves to translationally move the isolation platform 142 and the disc-shaped rotatable stage 144 as a single unit. The isolation platform 142 and the disc-shaped rotatable stage 144 are also capable of being moved relative to one another and the movement of the isolation platform 142 and the disc-shaped rotatable stage 144 relative to one another is referred to as a tray-centric movement of the venue tray 140. The venue tray 140 also includes a home row seating section 148 that is comprised of a plurality of arcuate rows of individual seats, wherein the curvature of the arcuate rows is compatibly configured with the circumferential periphery of the rotating stage 144. The home row seating section 148 of the venue tray 140 is rotatably secured to the base 146 and can rotate relative to the base 146.

The venue tray 140 is thus configured to permit multiple independent tray-centric movements: (a) vertical movement of the isolation platform 142 relative to the disk-shaped rotatable stage 144, (b) rotational movement of the isolation platform 142 relative to the disk-shaped rotatable stage 144, and (c) rotational movement of the movement of the disk-shaped rotatable stage 144 (with the isolation platform 142 entrained therewith) relative to the home row seating section 148. For an example of one of these tray-centric movements, reference is had to FIG. 4, which is a top perspective view of the venue tray shown in FIG. 3 in an arbitrary milestone position, the isolation platform 142 of the venue tray 140 has moved relative to the disc-shaped rotatable stage 144 in that the isolation platform 142 has moved from its arbitrary start position shown in FIG. 3 to an arbitrary milestone position shown in FIG. 4. The specific movements of the isolation platform 142 in moving from its arbitrary start position shown in FIG. 3 to an arbitrary milestone position shown in FIG. 4 comprise: (a) a vertical movement of the isolation platform 142 to a new lower position more adjacent the disk-shaped rotatable stage 144 as compared to the position of the isolation platform 142 as shown in FIG. 3 and (b) an angular movement of the isolation platform 142 in a clockwise manner relative to the disc-shaped rotatable stage 144.

The venue tray arrangement 110 includes a venue tray 160 that is comprised of a plurality of arcuate rows of individual seats, wherein the curvature of the arcuate rows is compatibly configured with respect to the overall curvature of the plurality of arcuate rows of individual seats of the venue tray 140. Each venue tray is configured to move relative to at least one other venue tray and a movement of a pair of respective venue trays relative to one another, or a movement of three or more venue trays relative to one another, is referred to as a tray-to-tray movement.

As seen in FIG. 5(*a*), which is a top perspective view of the venue tray 140 shown in FIG. 3 having a flexible configuration stage and a home row seating section and another venue tray 160 having a downrange seating section 162, the venue tray 140 and the venue tray 160 are configured to move relative to one another in a tray-to-tray movement. As an example of a tray-to-tray movement, reference is had to FIG. 5(*b*), which is a top perspective view of the venue tray 140 in an arbitrary milestone position. As seen in FIG. 5(*b*), the venue tray 140 having the isolation platform 142 and the disc-shaped rotatable stage 144 has been rotated in an angular movement about its rotation axis in a clockwise direction from an arbitrary start position shown in FIG. 5(*a*) in which the audience members of the home row seating section 148 are observer-aligned with a sight line SL-A to an arbitrary milestone position shown in FIG. 5(*b*) in which the audience members of the home row seating section 148 are observer-aligned with a sight line SL-C which is diametrically opposite to the sight line SL-A.

Referring back to FIG. 3(*a*), the venue trays 140, 160, and platform 190 are shown. The trays can be arranged on top of one another, as shown, or one tray can be contained within another tray. The platform 142, stage 144, and the trays 140, 160, 190 are each rotatable about a respective center point C1, C2, C3, C4, or C4, and independently rotate about the center point with respect to one or more of the other components. Thus as shown in FIG. 4, the platform 142 can rotate about center point C1 with respect to the stage 144, trays 140, 160 and platform 190. The stage 144 can also rotate with respect to trays 140, 160 and platform 190, so that the platform 142 moves from a position closer to the partitions 116 toward the rear of the arena 114 (see FIGS. 3(*b*), 5(*a*)) to a position further from partitions 116 toward the rear of the arena 114 (FIGS. 4, 5(*d*)).

Referring to FIGS. 5(*a*) and 5(*b*), rotation of the venue tray 140 is illustrated in a non-limiting example of the invention. In FIG. 5(*a*), venue tray 140 is in a first position whereby the stage 144 is closer to the partitions 116 and the rear of the arena 114, and the home seating section 148 is positioned further from the partitions 116 and the rear of the arena 114. In FIG. 5(*b*), the entire venue tray 140 has been rotated approximately 180° with respect to the venue tray 160 (which remained fixed) and platform 190 (which remained fixed), so that the home seating section 148 and stage 144 have switched positions. Here, the home seating section 148 is closer to the partitions 116 and the rear of the arena 114 and the stage 144 is further from the partitions 116 and the rear of the arena 114.

Referring to FIGS. 5(*b*) and 5(*c*), movement of the balcony trays 180 is illustrated in another non-limiting example of the invention. Here, the venue trays 140, 160, platform 190, platform 142, and stage 144 remain stationary. In FIG. 5(*b*), the balcony trays 180 are positioned adjacent and touching one another. In FIG. 5(*c*), the balcony trays 180 are independently moved with respect to each other so that they are equally spaced about the arena 114. The balcony trays 180 also move with respect to the venue trays 140, 160, platforms 142, 190, stage 144 to provide different sight lines of the platform 142 and stage 144.

It is noted that FIGS. 5(*a*)-(*d*) only illustrate several positions of the platforms 142, 190, venue trays 140, 160, balcony trays 180, and stage 144. It will be appreciated that a vast number of other positions can be achieved. The platforms 142, 190, venue trays 140, 160 and stage 144 can be rotated independent of each other over a full 360°. And the balcony trays 180 can be positioned at any point about the periphery of the arena 114 independent of the platforms 142, 190, venue trays 140, 160 and stage 144.

Figure 6:
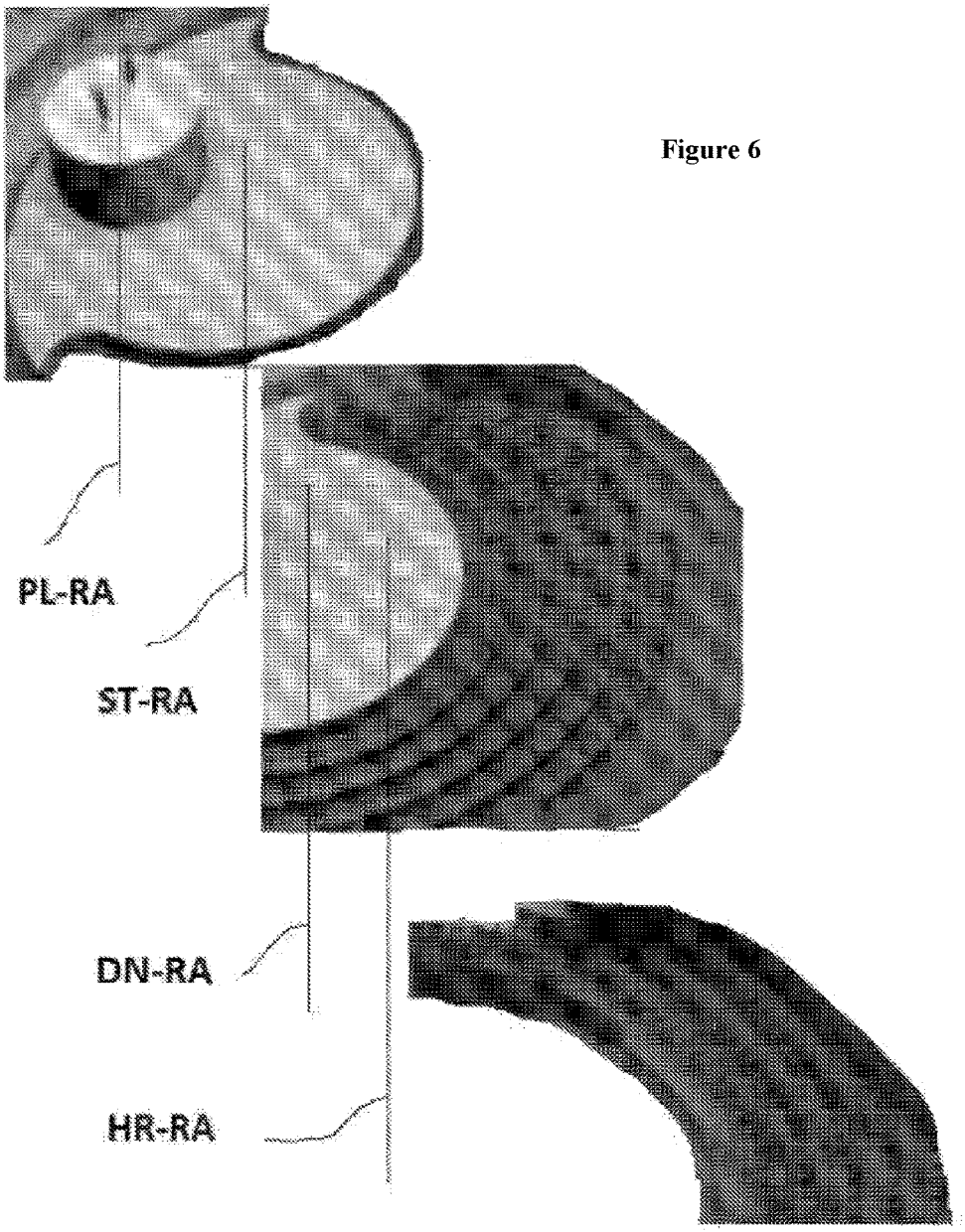
FIG. 6 is a schematic exploded top perspective view of the venue tray and the other venue tray in their positions illustrated in FIG. 5(*a*)
Figure 7:
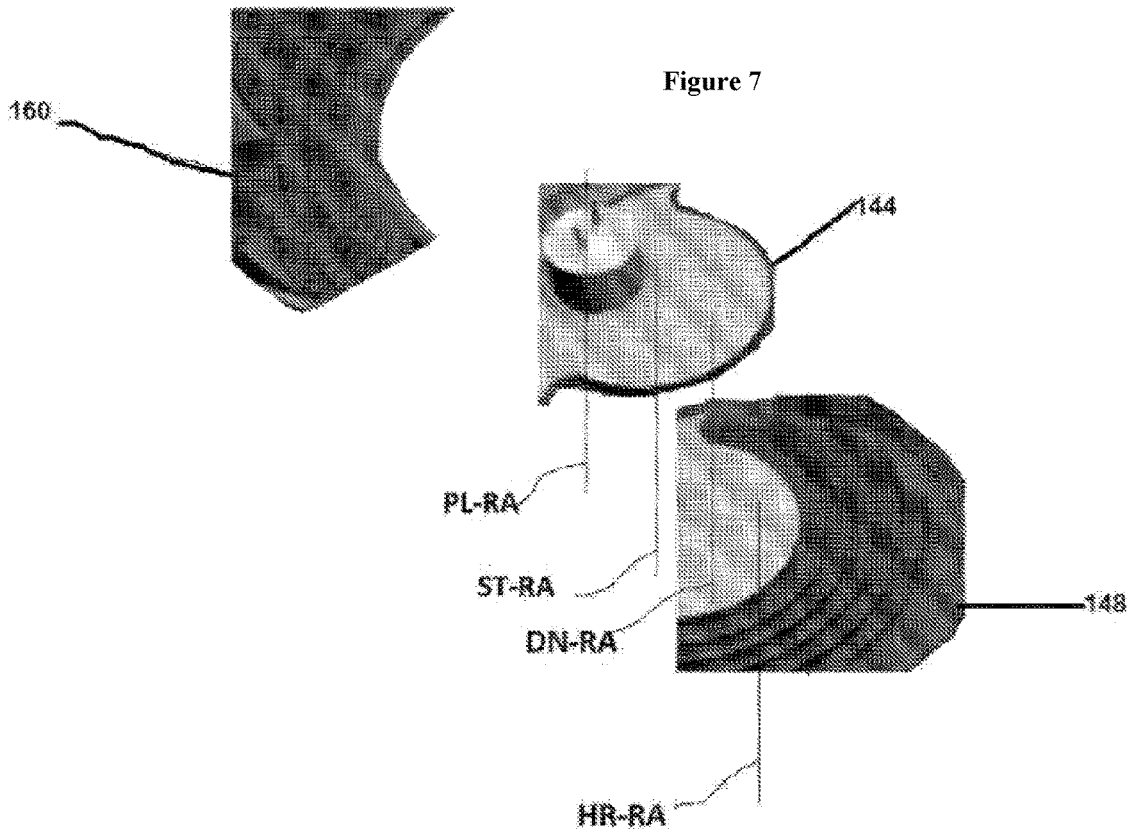
FIG. 7 is a schematic exploded top perspective view of the venue tray and the other venue tray in their positions illustrated in FIG. 5(*b*)

As seen in FIG. 6, which is a schematic exploded top perspective view of the venue tray 140 and the other venue tray 160 in their positions illustrated in FIG. 5(*a*), the relationship of the various axes of rotations of the components of the venue tray 140, the venue tray 140 itself, and the venue tray 160 are schematically illustrated. Namely, the axis of rotation PL-RA of the isolation platform 142 passes through the venue tray 140 and is at a radial spacing from the axis of rotation ST-RA of the rotating stage 144 of the venue tray 140, the axis of rotation ST-RA of the rotating stage 144 of the venue tray 140 lies radially inwardly of the axis of rotation PL-RA of the isolation platform 142 (as viewed relative to the partition wall assembly 116), the axis of rotation HR-RA of the base 146 of the venue tray 140 lies radially inwardly of the axis of rotation ST-RA of the rotating stage 144 of the venue tray 140, and the axis of rotation DN-RA of the venue tray 160 lies radially inwardly of the axis of rotation HR-RA of the base 146 of the venue tray 140. As seen in FIG. 7, which is a schematic exploded top perspective view of the venue tray 140 and the other venue tray 160 in their positions illustrated in FIG. 5(*b*), the relationship of the various axes of rotations of the components of the venue tray 140, the venue tray 140 itself, and the venue tray 160 are schematically illustrated and it can be seen that the venue tray 160 has been rotated about its axis of rotation DN-RA (and thus moved relative to the venue tray 140) such that the downrange seating section 162 of the venue tray 160 is now disposed radially outwardly of the venue tray 140 in the direction of the partition wall assembly 116.

Figure 10:
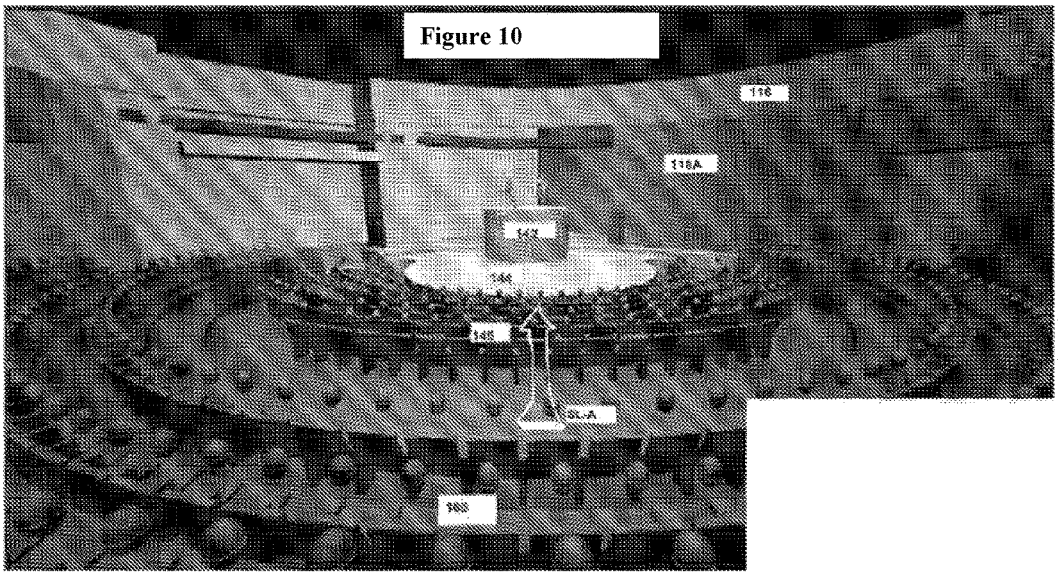
FIG. 10 is a top perspective view of the venue tray shown in FIG. 3 having a flexible configuration stage and a home row seating section and another venue tray having a downrange seating section.

A venue tray individually may be configured to move relative to the arena 114 for the purpose, for example, of changing a viewing orientation of audience members supported on the venue tray, or positioning the venue tray relative to a structure of the arena 114, and a movement of a venue tray relative to the arena 114 is referred to as an arena reset movement. In similar manner, a plurality of venue trays may be configured to move relative to the arena 114 for the purpose, for example, of changing a viewing orientation of audience members supported on the venue trays, or positioning the venue trays relative to a structure of the arena 114, and such movements of the venue trays relative to the arena 114 are also referred to as arena reset movements. FIG. 10 is a top perspective view of the venue tray 140 shown in FIG. 3 having a flexible configuration stage and a home row seating section and another venue tray 160 having a downrange seating section and it can be seen that the audience members of the home row seating section 144 of the venue tray 140 and the downrange seating section 162 of the venue tray 160 are observer-aligned with the sight line SL-A in an arbitrary start position.

The audience members of the home row seating section 144 of the venue tray 140 and the downrange seating section 162 of the venue tray 160 are thus able, in this disposition of the venue tray arrangement 110, to view a live actor presentation or a display occurring on the isolation platform 142 and the disc-shaped rotatable stage 144. Additionally, the audience members of the home row seating section 144 of the venue tray 140 and the downrange seating section 162 of the venue tray 160 are able to view an area radially outwardly of the partition wall assembly 116 in the event that the shutter 118A has been angularly displaced to expose an opening in the partition wall assembly. Live actors and/or display equipment may be positioned in this area radially outwardly of the partition wall assembly 116 and/or may be moved through the opening in the partition wall assembly and onto the isolation platform 142 and/or the disc-shaped rotatable stage 144. The respective area radially outwardly of the one opening that is selectively covered and uncovered by the shutter 118A is a first periphery event portion and the respective area radially outwardly of the opening that is selectively covered and uncovered by the shutter 118B is a second periphery event portion.

Figure 11:
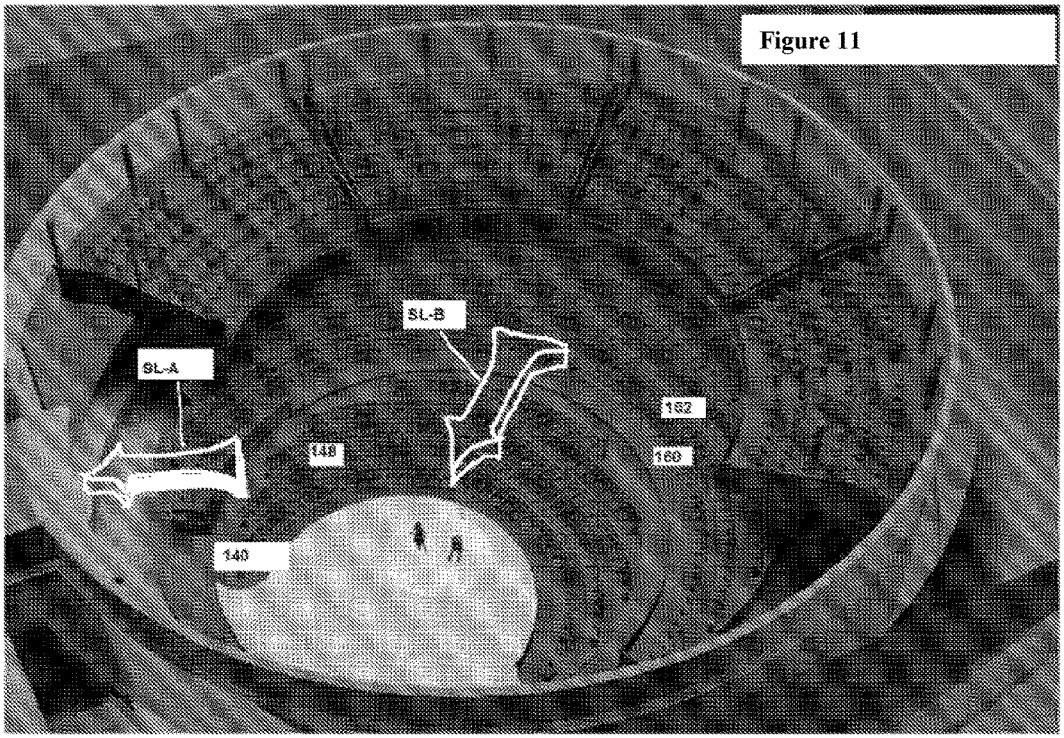
FIG. 11 is a top perspective view of the venue tray shown in FIG. 3 which has a flexible configuration stage and a home row seating section and the venue tray having a downrange seating section and it can be seen that the venue tray and the venue tray have been moved in an arena reset movement during which the venue tray and the venue tray were coupled to one another for the arena reset movement.

FIG. 11 is a top perspective view of the venue tray 140 shown in FIG. 3 which has a flexible configuration stage and a home row seating section and the venue tray 160 having a downrange seating section and it can be seen that the venue tray 140 and the venue tray 160 have been moved in an arena reset movement during which the venue tray 140 and the venue tray 160 were coupled to one another for the arena reset movement. The arena reset movement involved the movement of the venue tray 140 and the venue tray 160 from the arbitrary start position shown in FIG. 10 to a new position. Specifically, in preparation for the arena reset movement, the venue tray 140 and the venue tray 160 have been coupled to one another at their respective dispositions in which the audience members of the home row seating section 144 of the venue tray 140 and the downrange seating section 162 of the venue tray 160 are observer-aligned with the sight line SL-A (i.e., the position illustrated in FIG. 10) and, then, in execution of the arena reset movement, the venue tray 140 and the venue tray 160 have been moved as a single unit without relative movement therebetween (i.e., no tray-to-tray movement) and the movement of the venue tray 140 and the venue tray 160 in this manner has been ceased at a position in which the audience members of the home row seating section 144 of the venue tray 140 and the downrange seating section 162 of the venue tray 160 are observer-aligned with a sight line SL-B in an arbitrary milestone position, wherein the sight line SL-B is perpendicular to the sight line SL-A and the sight line SL-C. It is noted that tray-centric movement, tray-to-tray movement, and arena reset movement can occur simultaneously with one another.

FIGS. 10-11 show that an audience member in the home row seating section 144 of the venue tray 140 and an audience member in the downrange seating section 162 of the venue tray 160 see the same display when the home row seating section 144 of the venue tray 140 and the downrange seating section 162 of the venue tray 160 are observer-aligned with a sight line, such as the disposition of the venue tray 140 and the venue tray 160 that has been described with respect to FIG. 11.

As shown in FIG. 5(*c*), which is a top perspective view of the venue tray arrangement and the arena, the venue tray arrangement 110 also comprises a plurality of balcony trays 180. Each balcony tray 180 is supported from an upper portion of the partition wall assembly 116 in a manner which permits the balcony tray to be selectively angularly moved relative to the partition wall assembly 116 and to be moved angularly relative to any adjacent balcony trays. Each balcony tray 180 includes a plurality of individual seats arranged in rows and the balcony tray supports the seats at a height at which the audience members occupying the seats have a view of the interior of the arena that is not obstructed by the venue trays 140 and the venue trays 160.

The venue tray arrangement 110 thus provides the capability to re-position or re-orient the seating of audience members to a wide variety of locations within the arena 114 of the venue 112. As shown in FIG. 5(*c*), the venue tray arrangement 110 is operable to orient the venue tray 140 and the venue tray 160, as well as to orient the balcony trays 180, in a manner in which all of the audience members seated on the venue trays can view and hear the presentation of a live actor event or another event presented on the venue tray 140. Moreover, all of these audience members can see and hear any displays or presentations that occur radially outwardly of the arena 114—that is, radially outwardly of the prosceniums that are delimited by the partition wall assembly 116 via selective movement of the shutters 118A and 118B to cover and uncover openings in the partition wall assembly. For example, a first group of actors may perform a performance on the isolation platform 142 of the venue tray 140, a second group of actors may, at the same time, perform a performance on the rotating stage 144 of the venue tray 140, and, at the same time, a third group of actors can perform a performance radially outwardly of the partition wall assembly 116 and all of the three performances are viewable by all of the audience members seated in the venue tray 140, the venue tray 160, and the balcony trays 180.

Figure 13:
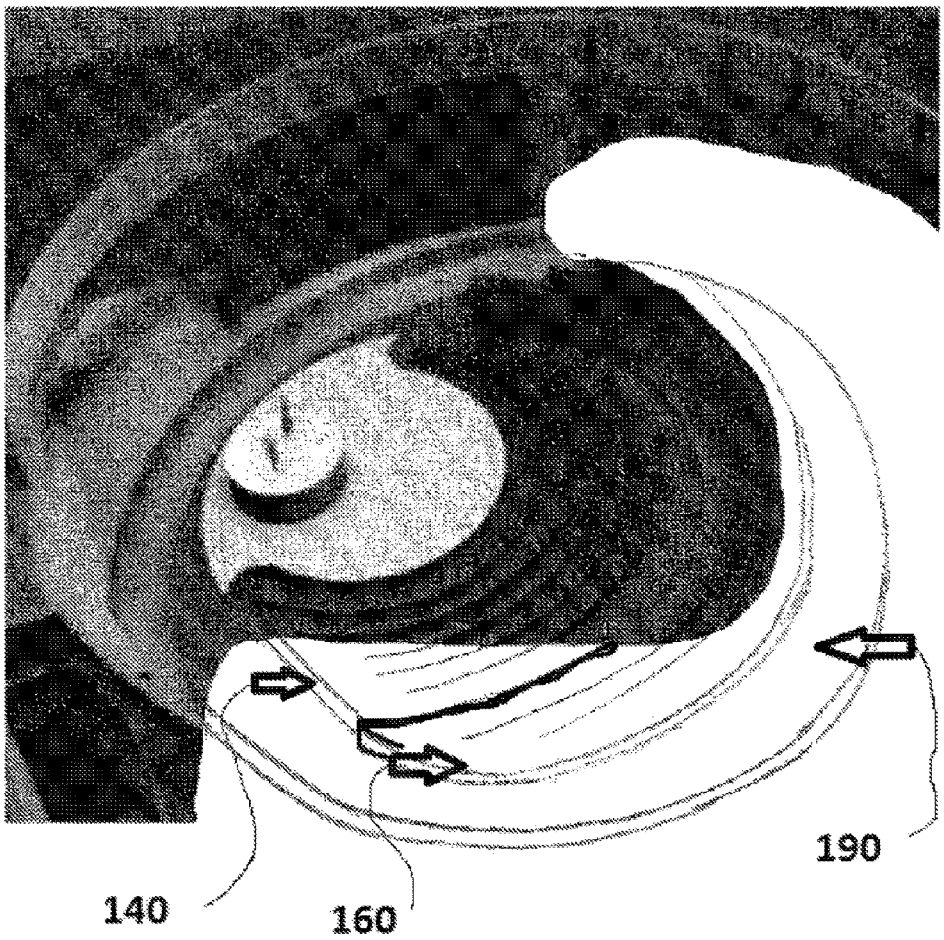
FIG. 13 is a top perspective partial cutaway view of the venue tray arrangement and the arena in the disposition shown in FIG. 9.

The isolation platform 142 of the venue tray 140 is configured with a capability to be raised vertically and lowered vertically and such a vertical adjustment capability can be provided, for example, via a hydraulic cylinder and piston (not shown). As shown in FIG. 13, which is a top perspective partial cutaway view of the venue tray arrangement and the arena in the disposition shown in FIG. 11, the venue tray 140 and the venue tray 160 are commonly supported on a move platform 190. The move platform 190 is itself supported on a suitable support arrangement such as, for example, a roller arrangement (not shown) located on a surface of the arena 114, as has been heretofore described. The venue tray 140 and the venue tray 160 can be individually operated for separate movements along the surface of the move platform 190, such as the tray-centric movements and the tray-to-tray movements herein described, and the move platform 190 can be moved within the arena 114 to jointly move the venue tray 140 and the venue tray 160 to new orientations.

Figure 12:
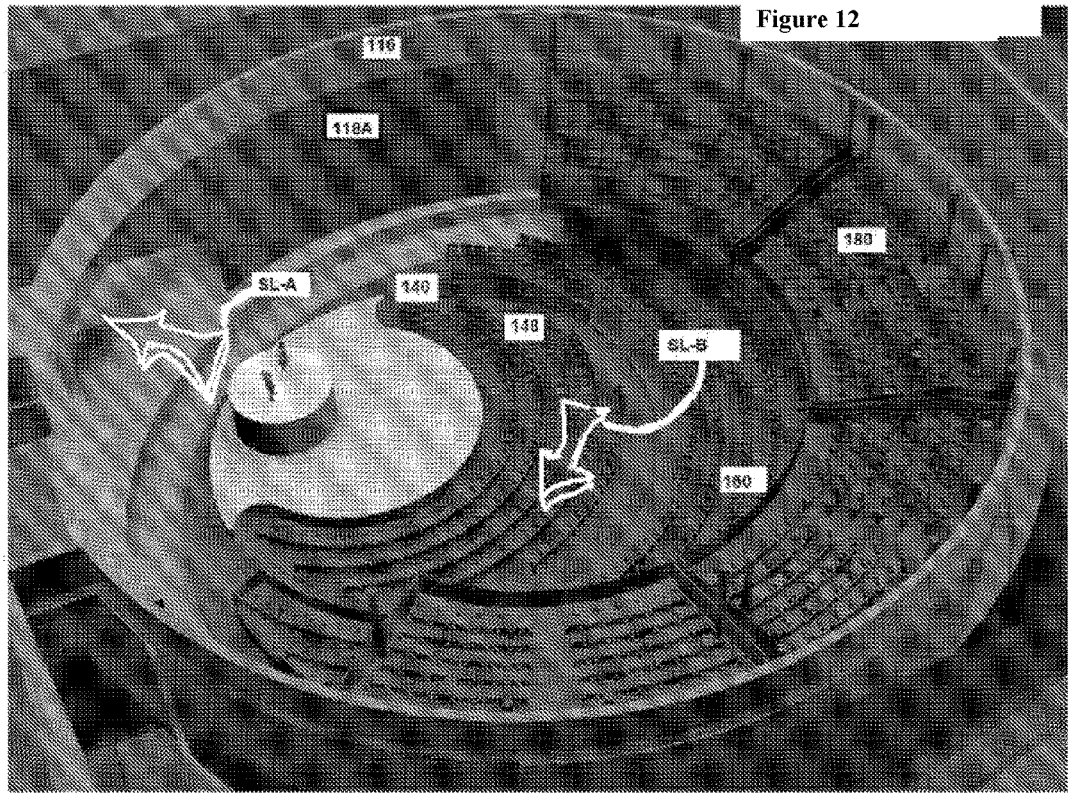
FIG. 12 is a top perspective view of the venue tray arrangement and the arena with certain components of the venue tray arrangement configured to execute an arena reset movement.

The range of arena configurations that can be obtained via tray-centric movements, tray-to-tray movements, and arena reset movements permit the venue tray arrangement 110 to provide the capability to initially orient all of the venue trays and the balcony trays such that the audience members seated thereon can view a single performance or a set of performances that are viewable through a first given opening formed in the partition wall assembly 116 and to thereafter re-orient all of the venue trays and the balcony trays such that the audience members seated thereon can view a single performance or a set of performances that are viewable through a second given opening formed in the partition wall assembly 116 that is angularly offset from the first given opening. An initial orientation of this type in which all of the venue trays and the balcony trays such that the audience members seated thereon can view a single performance or a set of performances that are viewable through a first given opening formed in the partition wall assembly 116 has been described with respect to FIG. 11. FIG. 12, which is a top perspective view of the venue tray arrangement and the arena with certain components of the venue tray arrangement configured to execute an arena reset movement, shows the disposition of the venue tray arrangement 110 after the venue tray arrangement has been operated to re-orient all of the venue trays and the balcony trays from their dispositions shown in FIG. 11 such that the audience members seated thereon can view a single performance or a set of performances that are viewable through another opening formed in the partition wall assembly 116 that is angularly offset from the respective opening through which the audience members have viewed a performance in the disposition shown in FIG. 11. In connection with the re-orienting operation, the venue tray 140 has been operatively coupled with the venue tray 160 and both of these trays have been subjected to a common slewing motion that has brought these two venue trays to a new orientation in which the trays are observer-aligned with a fresh sight line that passes through the another opening. This fresh sight line is the sight line SL-A. Additionally, the balcony trays 180 have been angularly moved relative to the arena 114 to ensure that the audience members seated thereon can also view the performance. This re-orientation capability of the venue tray arrangement 110 enables the audience members to see different performances and, as well, permits the stage production organizer or the stage crews the capability to close from view an opening in the partition wall assembly 116 and then, at an area behind the now-closed off opening, to rearrange or position new actors or scenery components.

The slewing motion of a tray can be in the form of a rotational motion of a base of the tray such as, for example, the base 146 of the venue tray 140 on which the isolation platform 142 and the rotating stage 144 are supported. Each venue tray may be configured in any suitable geometry and may include a uniform flat surface such as, for example, a planar surface, or the venue tray may be configured with varying elevations. Additionally, each tray may be provided with suitable railings, posts, illumination structures, sound structures, or other structures. Moreover, each venue tray may be configured to provide a portion available for live performances by live actors or for a display presentation, may be configured to provide audience seating or standing room for audience members, or may be configured to provide a combination of a stage or performance area and, as well, a seating or standing area for audience members. For example, the venue tray 140 is configured as such a combination tray while the venue tray 160 is configured solely as a structure for accommodating audience members. In contrast, each of the balcony trays 180 are configured solely to accommodate audience members and do not include any display or performance areas.

The temporary linkage of a venue tray to another venue tray for an arena reset movement may be effected by any suitable mechanism including, for example, selectively engageable hook and pin structures, bolt structures, and/or magnetic interconnecting structures. Additionally, a given pair of venue trays or more than two venue trays may be commonly supported on an underlying structure or suspended from an overhead structure whereby such underlying structure or overhead structure is configured to commonly move the respective pair or plurality of venue trays to re-orient the venue trays and bring the audience members to a different orientation in which they are observer-aligned with a fresh new sight line.

The venue trays may be supported on any suitable mechanisms that sufficiently support the mass of the tray and which permit flexible and hindrance-free movement of the venue tray. For example, the base 146 of the venue tray 140 may be supported on a plurality of rollers (not shown) and an underside of the base 146 of the venue tray may be formed with a planar surface that rests upon the rollers. In such a configuration, the venue tray freely rolls on the rollers and a suitable propulsion mechanism such as, for example, a hydraulic piston or a chain or cable windable and unwindable from a winch (not shown) can be deployed to bring about the selected movement of the venue tray relatively along the rollers.

Figure 8:
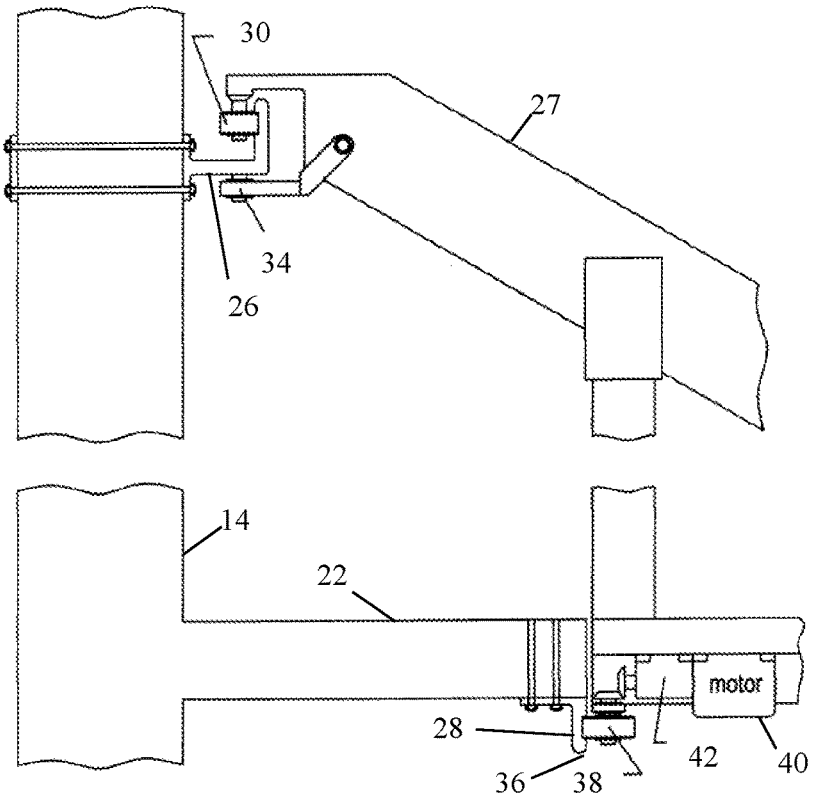
FIG. 8 is an enlarged perspective view of a portion of the partition wall assembly and a portion of a respective balcony tray.

The support and movement of the balcony trays 180 can be configured in any suitable manner. For instance, in connection with the support and movement of the balcony trays 180 relative to the partition wall assembly 116, reference is had to FIG. 8, which is an enlarged perspective view of a portion of the partition wall assembly and a portion of a respective balcony tray. The partition wall assembly 116 includes a top superstructure 22 extending circumferentially around and supported on vertical beams 14 of the assembly and the superstructure 22 supports an upper rail 26 and a lower rail 28 designed for supporting a balcony tray 180. With regard to rotational displacement of the balcony tray 180, a roller bearing 30 is mounted to a distal end of an arm 27 extending from the balcony tray 180. The roller bearing 30 is adapted to ride within a raceway 32 defined by the upper rail 26. A safety lock 34, also extending from the arm 27, is positionable below the raceway 32 for securing the roller bearing 30 in the raceway 32. Another raceway 36 is defined in the lower rail 28 and is adapted to accommodate a drive wheel 38. The drive wheel 38 is actuated by an electric motor 40 mechanically linked to the drive wheel 38 by a beveled gear arrangement 42 or by other drive force. The gear ratio can be designed to the operating specifications. The motor drive 40 can also be computer operated by command at selected speeds and directions for displacing the balcony tray 180 in either a clockwise or counterclockwise direction along the partition wall assembly 116. The support and the movement of the balcony tray 180 can alternatively be effected via hydraulic, air cushion or magnetic force.

Figure 9:
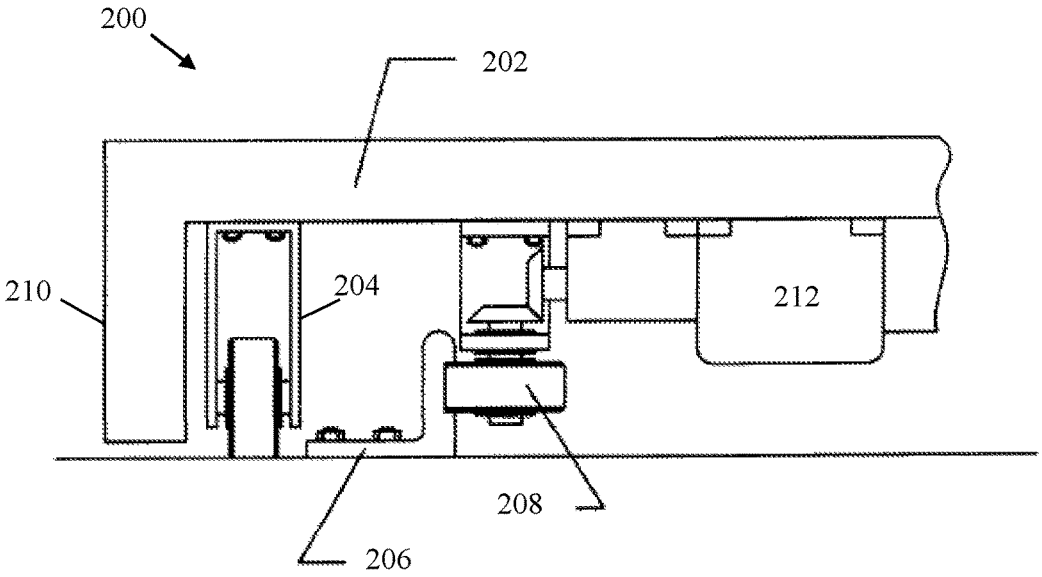
FIG. 9 is an enlarged front plan view of the portion of the partition wall assembly and the portion of the respective balcony tray shown in FIG. 10.

The platform 142, stage 144, venue trays 140, 160 and platform 190 can be configured in any suitable manner that enable rotational movement, and for the platform 142 to be raised and lowered with respect to the stage 144. For instance in FIG. 9, those elements, generally referred to as tray 200, can have a top platform or plate 202. One or more wheel assemblies 204 can be provided at the bottom of the plate 202 and positioned about the outer circumference (or more centrally) of the plate 202. The wheel assemblies 204 enable the entire tray 200 to move. The plate 202 can have a downward extending lip 210 at the very outer periphery of the plate 202 to prevent damage to the wheel assemblies 204 and for safety of arena patrons. An annular track 206 can be provided on the arena floor and extend vertically upward from the floor. A drive assembly having a drive wheel 208 can be coupled to the bottom surface of the plate 202. The drive wheel 208 can extend downward and be substantially horizontal to be orthogonal to the track 206. A motor 212 is attached to the plate 202 and operates the drive wheel 208 to rotate against the track 206 to move the plate 202 in a clockwise or counter-clockwise direction. It is further noted that for the venue tray 140, the annular track 206 can be mounted to the top surface of the plate of the venue tray 160, and the wheel assemblies can ride along the top surface of the venue tray 160. This configuration can also be used to move the partition wall assemblies 116.

Accordingly, the platform 142, stage 144, venue trays 140, 160 and platform 190 and balcony tray 180 can move quietly and reliably. The configuration cannot be accessed by patrons who might be walking about in the arena 114. Of course, other suitable configurations can be provided within the spirit and scope of the invention. For instance, those components can be supported magnetically and/or moved manually, magnetically, or by one or more pulley systems.

It is further noted that the platform 142, stage 144, trays 140, 160, and platform 190 are shown and described as being circular. However, it will be appreciated that other shapes can be provided. And those elements can be arranged differently with respect to one another. For instance, the platform 142 can be provided at the center of the stage 144 rather than being offset toward one side of the stage 144. And the venue tray 140 can be provided at the center of the venue tray 160, rather than being offset toward one side of the venue tray 160. Still further, multiple platforms 142 can be provided on each stage 144, multiple stages 144 can be provided on each venue tray 140, multiple venue trays 140 can be provided on venue tray 160, and multiple venue trays 160 can be provided on platform 190. And, a stage 144 and/or platform 142 can be provided on the venue tray 160 and/or platform 190.

While the invention has been described with reference to one or more embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. In addition, all numerical values identified in the detailed description shall be interpreted as though the precise and approximate values are both expressly identified.

What is claimed is:

1. A method for positioning audience members at locations for viewing an event occurring at an event portion at which a live actor makes a presentation and/or a display is shown, the method comprising:

providing a first venue tray, the first venue tray having a close range event portion at which a live actor can make a presentation and/or a display can be shown and a home row seating section, a second venue tray, the second venue tray having a downrange seating section, a first periphery event portion at which a live actor can make a presentation and/or a display can be shown, and a second periphery event portion at which a live actor can make a presentation and/or a display can be shown, the first venue tray and the second venue tray being displaceable relative to one another to a position in which audience members located on the first venue tray view a presentation or a display at the close range event portion of the first venue tray along a different sight line than audience members located on the second venue tray, the first venue tray and the second venue tray being positionable relative to one another such that audience members located on the first venue tray view a presentation or a display at the first periphery portion along the same sight line as audience members located on the second venue tray, and the first venue tray and the second venue tray being displaceable as a single unit to a location at which audience members located on the first venue tray view a presentation or a display at the second periphery event portion along the same sight line as audience members located on the second venue tray; and selectively moving the first venue tray and/or the second venue tray.

2. The method of claim 1, wherein the first venue tray and second venue tray can be separately rotated with respect to each other.

3. The method of claim 1, further comprising providing one or more balcony venue trays positioned about an outer periphery of the event portion, each one or more balcony venue trays separately movable about the outer periphery of the event portion.

4. The method of claim 1, further comprising providing a partition wall assembly about the first venue tray, the partition wall assembly sliding between a first position and a second position.

5. The method of claim 1, further comprising providing a platform mounted to the first venue tray, the platform rotating with respect to the first venue tray.

6. The method of claim 5, wherein the platform can be raised/lowered with respect to the first venue tray.

7. The method of claim 1, further providing the first venue tray with a rotatable stage, the rotatable stage rotating with respect to the first venue tray.

8. The method of claim 7, further providing the first venue tray with a rotatable platform mounted to the rotatable stage, the platform rotating with respect to the stage.

9. An arrangement comprising:

a first venue tray, the first venue tray having a close range event portion at which a live actor can make a presentation and/or a display can be shown and a home row seating section;

a second venue tray, the second venue tray having a downrange seating section;

a first periphery event portion at which a live actor can make a presentation and/or a display can be shown; and a second periphery event portion at which a live actor can make a presentation and/or a display can be shown, the first venue tray and the second venue tray being displaceable relative to one another to a position in which audience members located on the first venue tray view a presentation or a display at the close range event portion of the first venue tray along a different sight line than audience members located on the second venue tray, the first venue tray and the second venue tray being positionable relative to one another such that audience members located on the first venue tray view a presentation or a display at the first periphery portion along the same sight line as audience members located on the second venue tray, and the first venue tray and the second venue tray being displaceable as a single unit to a location at which audience members located on the first venue tray view a presentation or a display at the second periphery event portion along the same sight line as audience members located on the second venue tray.

10. The arrangement of claim 9, wherein the first venue tray and second venue tray can be separately rotated with respect to each other.

11. The arrangement of claim 9, further comprising one or more balcony venue trays positioned about an outer periphery of the event portion, each one or more balcony venue trays separately movable about the outer periphery of the event portion.

12. The arrangement of claim 9, further comprising a partition wall assembly positioned about the first venue tray, the partition wall assembly sliding between a first position and a second position.

13. The arrangement of claim 9, further comprising a platform mounted to the first venue tray, the platform rotating with respect to the first venue tray.

14. The arrangement of claim 13, wherein the platform can be raised/lowered with respect to the first venue tray.

15. The arrangement of claim 9, further comprising a rotatable stage mounted to the first venue tray, the rotatable stage rotating with respect to the first venue tray.

16. The arrangement of claim 15, further comprising a rotatable platform mounted to the rotatable stage, the platform rotating with respect to the stage.

* * * * *